US009340956B2

(12) United States Patent
Dilts et al.

(10) Patent No.: US 9,340,956 B2
(45) Date of Patent: May 17, 2016

(54) BOOM LOCK SYSTEM FOR WORK MACHINE

(71) Applicant: CNH AMERICA LLC, New Holland, PA (US)

(72) Inventors: Brad M. Dilts, Sedgwick, KS (US); Emory L. Frey, Clearwater, KS (US); Curtiss M. Lee, Garden Plains, KS (US); John M. Moffitt, Wichita, KS (US); Lance A. Taylor, Wichita, KS (US); Scott M. Timken, Bel Aire, KS (US)

(73) Assignee: CNH Industrial America LLC, New Holland, PA (US)

( * ) Notice: Subject to any disclaimer, the term of this patent is extended or adjusted under 35 U.S.C. 154(b) by 348 days.

(21) Appl. No.: 13/973,370

(22) Filed: Aug. 22, 2013

(65) Prior Publication Data

US 2014/0105713 A1 Apr. 17, 2014

Related U.S. Application Data

(60) Provisional application No. 61/712,502, filed on Oct. 11, 2012.

(51) Int. Cl.

| | |
|---|---|
| ***E02F 3/38*** | (2006.01) |
| ***E02F 9/24*** | (2006.01) |
| ***E02F 9/22*** | (2006.01) |
| ***E02F 3/34*** | (2006.01) |
| ***E02F 3/43*** | (2006.01) |

(52) U.S. Cl.

CPC ..... *E02F 9/24* (2013.01); *E02F 3/3414* (2013.01); *E02F 3/388* (2013.01); *E02F 3/432* (2013.01); *E02F 9/226* (2013.01); *E02F 9/2267* (2013.01)

(58) Field of Classification Search

CPC ..... E02F 3/388; E02F 3/432; E02F 9/2267

See application file for complete search history.

(56) References Cited

U.S. PATENT DOCUMENTS

| | | | | |
|---|---|---|---|---|
| 3,604,313 | A | 9/1971 | Fruehauf | |
| 3,730,362 | A * | 5/1973 | Hurlburt | E02F 3/3405 414/697 |
| 3,982,648 | A | 9/1976 | Luedtke et al. | |
| 3,995,761 | A * | 12/1976 | Hurlburt | E02F 3/388 414/697 |
| 4,388,038 | A * | 6/1983 | Freitag | E02F 3/388 414/685 |
| 4,417,502 | A | 11/1983 | Shore | |
| 5,169,277 | A | 12/1992 | Orser et al. | |
| 5,813,310 | A | 9/1998 | Hori et al. | |
| 7,160,076 | B2 | 1/2007 | Curl et al. | |
| 7,228,782 | B2 | 6/2007 | Kim | |
| 7,618,229 | B2 * | 11/2009 | Boling | E02F 3/3414 414/685 |
| 2003/0192732 | A1 | 10/2003 | Warkentine | |

* cited by examiner

*Primary Examiner* — Gerald McClain

(74) *Attorney, Agent, or Firm* — Sue C. Watson

(57) ABSTRACT

A work vehicle includes a frame including generally upwardly extending laterally spaced side members. A boom structure includes a pair of arms pivotably connecting the boom structure to the frame. A pressurized fluid system is operably associated with the boom structure for raising and lowering jointly each of the arms along a path of travel adjacent a corresponding side member. A stop member selectably extends outwardly from at least one of the side members between a locking position and a retracted position, the locking position extending at least a portion of the stop member into the path of travel of a corresponding arm of the boom structure to prevent a lowering movement of the boom structure beyond a predetermined height. A boom lock system prevents the fluid system from applying a fluid force to lower the boom structure when the stop member is in the locking position.

16 Claims, 4 Drawing Sheets

BOOM LOCK SYSTEM FOR WORK MACHINE

FIELD OF THE INVENTION

The present invention relates generally to the field of work vehicles. It relates more particularly to work vehicles having pivoting loader arms or booms or boom structures for manipulating attachments and systems for locking the loader arms or booms or boom structures in an elevated position.

BACKGROUND OF THE INVENTION

Work vehicles, such as conventional loaders are normally provided with a bucket carrying boom structure that moves up and down adjacent the outer sides of the loader. Generally, the bucket and boom structure is raised and lowered by a hydraulic lift cylinder which is interconnected between the vehicle or a support thereon and the boom structure which is actuated by a control lever in the operator's station.

For certain working situations and for other convenience reasons such as inspection, repair, maintenance, and storage, it is desirable to maintain a bucket and boom structure at a given elevation. Since many of the loaders today employ hydraulics for powering the loader boom, it is desirable to provide a secondary locking mechanism to prevent the boom structure from suddenly lowering due to a loss of hydraulic pressure, a failure in the hydraulic system, or an accidental movement of the control lever.

Loader designs involving conventional secondary locking mechanisms that prevent the boom structure from lowering due to movement of the control lever, i.e., a powered lowering force, present special challenges. That is, the associated loader components must be sufficiently robust to withstand a lowering force that may be applied at maximum hydraulic pressure. Therefore, the extent of the increase of such load carrying capacity typically requires an increase in material thickness and weight of structural components. As a result, the work vehicle purchase price and cost to operate the work vehicle increases.

Accordingly, it would be advantageous for work vehicles to include structurally reliable secondary locking mechanisms for booms without requiring the normally requisite increase in component load carrying capacity and costs associated therewith.

SUMMARY OF THE INVENTION

The present invention relates to a work vehicle including a frame including generally upwardly extending laterally spaced side members. A boom structure includes a pair of arms pivotably connecting the boom structure to the frame. A pressurized fluid system is operably associated with the boom structure for raising and lowering jointly each of the arms along a path of travel adjacent a corresponding side member. A stop member selectably extends outwardly from at least one of the side members between a locking position and a retracted position. The locking position extends at least a portion of the stop member into the path of travel of a corresponding arm of the boom structure to prevent a lowering movement of the boom structure beyond a predetermined height. A boom lock system prevents the fluid system from applying a fluid force to lower the boom structure when the stop member is in the locking position.

The present invention further relates to a work vehicle including a frame including generally upwardly extending laterally spaced side members. A boom structure includes a pair of arms pivotably connecting the boom structure to the frame. A pressurized fluid system is operably associated with the boom structure for raising and lowering jointly each of the arms along a path of travel adjacent a corresponding side member. A stop member selectably extends outwardly from at least one of the side members between a locking position and a retracted position. The locking position extends at least a portion of the stop member into the path of travel of a corresponding arm of the boom structure to prevent a lowering movement of the boom structure beyond a predetermined height. A boom lock system prevents the fluid system from applying a fluid force to lower the boom structure, while permitting the fluid system to apply a fluid force to raise the boom structure, when the stop member is in the locking position.

The present invention yet further relates to a method for operating a work vehicle includes providing a frame including generally upwardly extending laterally spaced side members. A boom structure includes a pair of arms pivotably connecting the boom structure to the frame. A pressurized fluid system is operably associated with the boom structure for raising and lowering jointly each of the arms along a path of travel adjacent a corresponding side member. A stop member selectably extends outwardly from at least one of the side members between a locking position and a retracted position. The locking position extends at least a portion of the stop member into the path of travel of a corresponding arm of the boom structure to prevent a lowering movement of the boom structure beyond the predetermined height. The method further includes preventing the fluid system from applying a fluid force to lower the boom structure when the stop member is in the locking position.

An advantage of the present invention is a work vehicle boom lock system that does not require an increase in load carrying capability during operation of the system.

A further advantage of the present invention is a work vehicle having components associated with the boom usable with a boom lock system that are less expensive.

A further advantage of the present invention is a work vehicle having a boom usable with a boom lock system that is less costly to operate.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

In the following description, right hand and left hand references are determined by standing at the rear of the machine facing in a direction of forward travel. Also, in the following description, it is to be understood that such terms "forward", "rearward", "left", "upwardly", etc. are words of convenience and are not to be construed as limiting terms.

Figure 1:
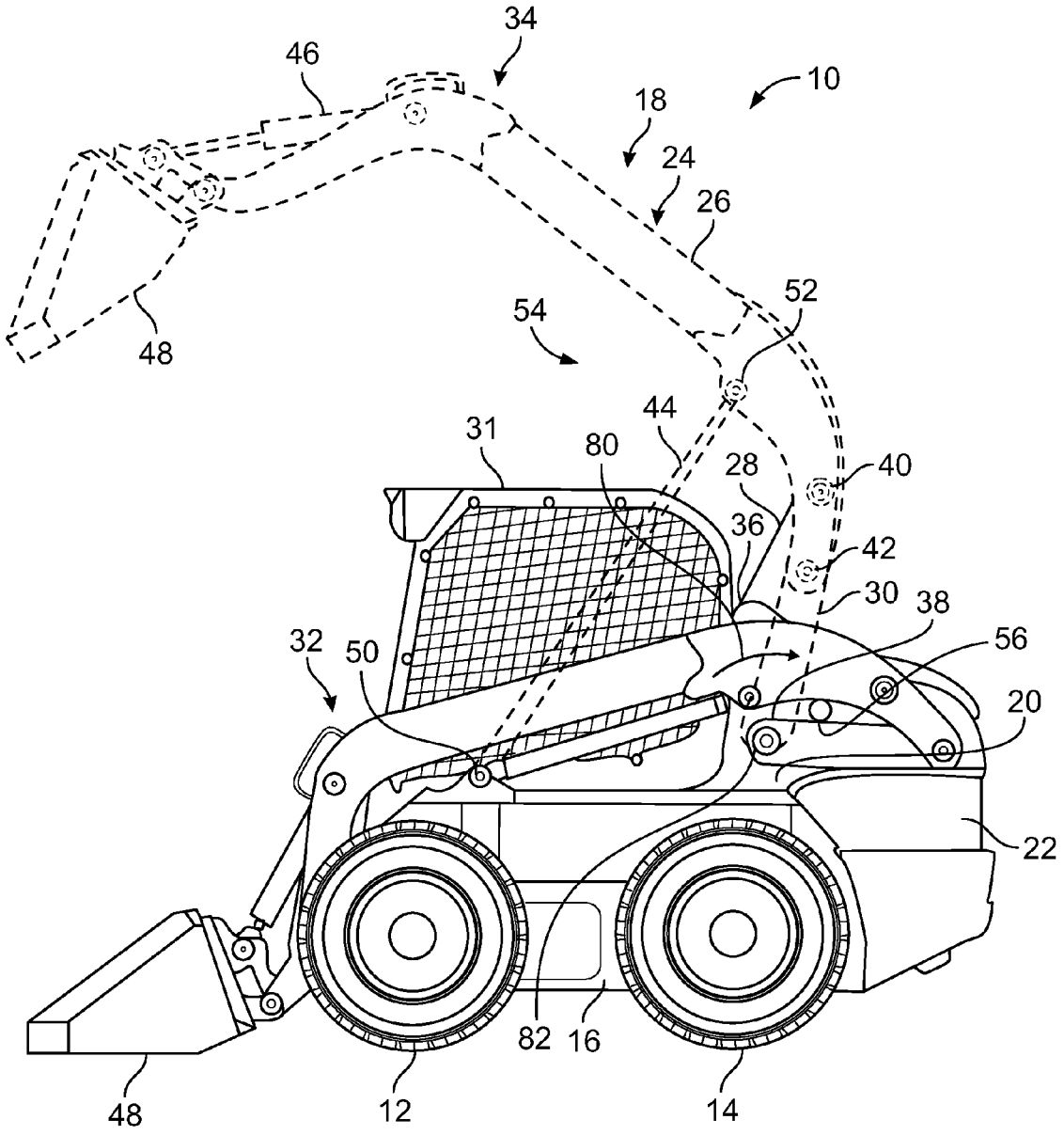
FIG. 1 is a side view of an embodiment of a work vehicle according to the present invention.

Referring now to the drawing and particularly to FIG. 1, there is shown a work vehicle, such as a loader or front end loader, also sometimes referred to as a skid steer loader being indicated generally by the numeral 10, forming an exemplary embodiment of the present invention. Although the front end loader illustrated is of the type employing a four bar linkage lift system, the principles of the invention may just as readily be incorporated into any type of loader.

Work vehicle 10 is provided with front and rear pairs of drive wheels 12, 14 which are rotatably connected to and support working vehicle frame 16. Cab 31 is supported by frame 16 and encloses an operator's station. Frame 16 includes a pair of laterally spaced generally vertically extending side members 20 (only one side member 20 is shown in FIG. 1) or side walls and has a rear engine compartment 22. The rear engine and related components are not shown since they are of conventional construction and not material to the present invention.

FIG. 1 further shows work vehicle 10 including a boom structure 18 shown in both a retracted position 32 and extended position 34 basically comprised of a pair of arms 24 comprised of corresponding upper arm portions 26 and corresponding lower arm portions 28, 30. Only one of each of arm 24, upper arm portion 26 and lower arm portions 28, 30 is shown in FIG. 1. Respective ends 36, 38 of lower arm portions 28, 30 are pivotably connected to respective side members 20 of the work vehicle 10, with respective opposed ends 40, 42 of lower arm portions 28, 30 pivotably connected to corresponding upper arm portions 26. Each upper arm portion 26 has one end pivotally connected to respective opposed ends 40, 42 of lower arm portions 28, 30, with each opposed end of upper arm portion 26 (as shown in extended position 34 of boom structure 18) extending generally forward and then bending generally forward and projecting therefrom past the forwardmost portion of work vehicle 10. The front portions of the upper arm portions 26 are adapted to receive a material handling implement, such as bucket 48 as shown in extended position 34 and at rest or on ground in a retracted position 32 of the preferred embodiment.

As with most commercial heavy duty loaders, the boom structure 18 is powered by a pressurized fluid system 54, such as hydraulics, preferably, by two hydraulic cylinders 44 (only one being shown in FIG. 1) which are pivotably connected at their cylinder ends to pivots 50 formed in such respective side members 20 of the loader adjacent the forward portion of cab 31. The rod portions of cylinders 44 are respectively pivotably connected at pivot 52 formed in upper arm portions 26. In one embodiment, the ends of hydraulic cylinders 44 can be reversed from the orientation shown in FIG. 1. Similarly, one or more hydraulic cylinder(s) 46 selectably controls the orientation of bucket 48 relative to boom structure 18.

Figure 2:
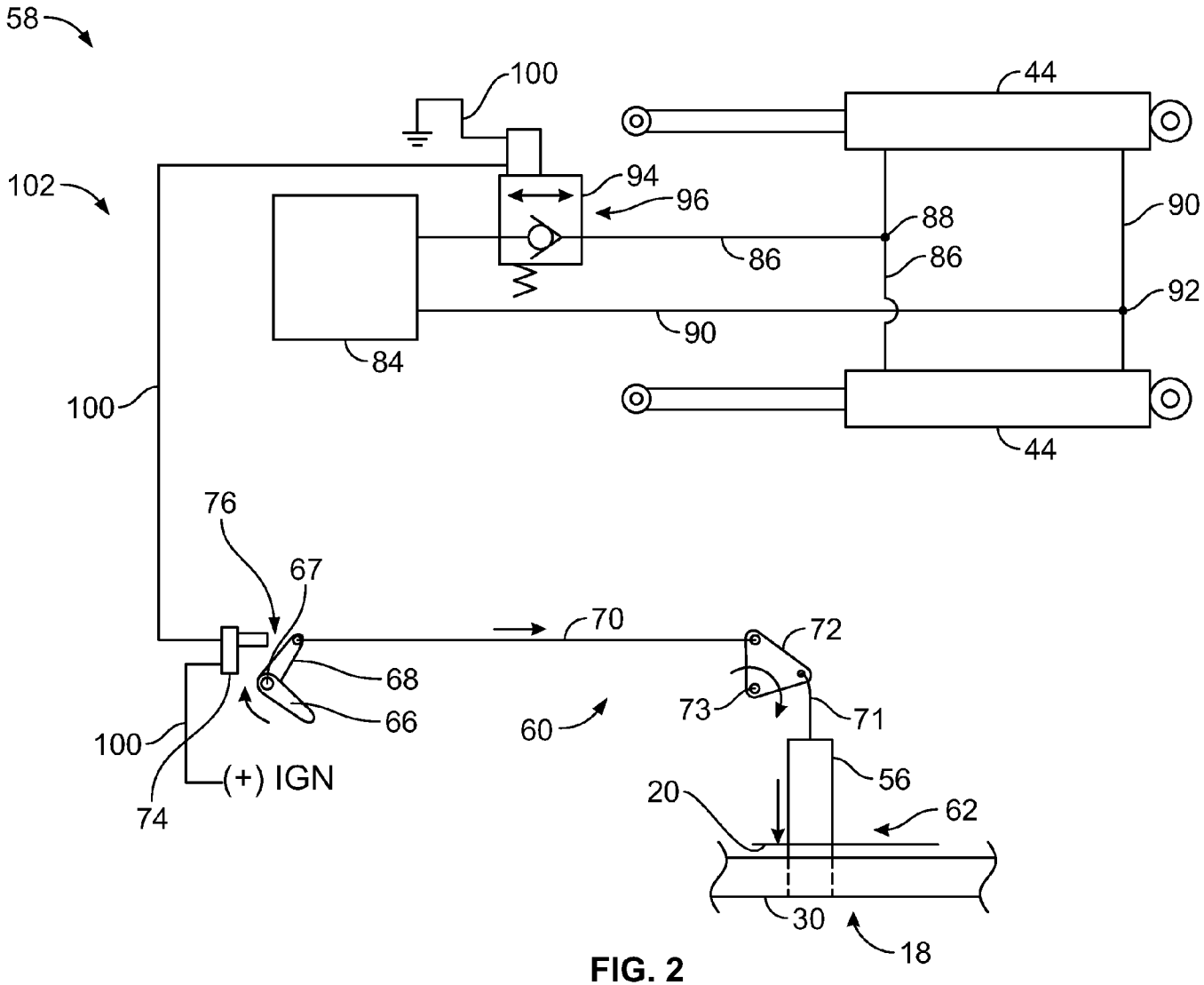
FIG. 2 is a schematic view of an exemplary work vehicle having a boom lock system with a stop member in a locking position according to the present invention.
Figure 3:
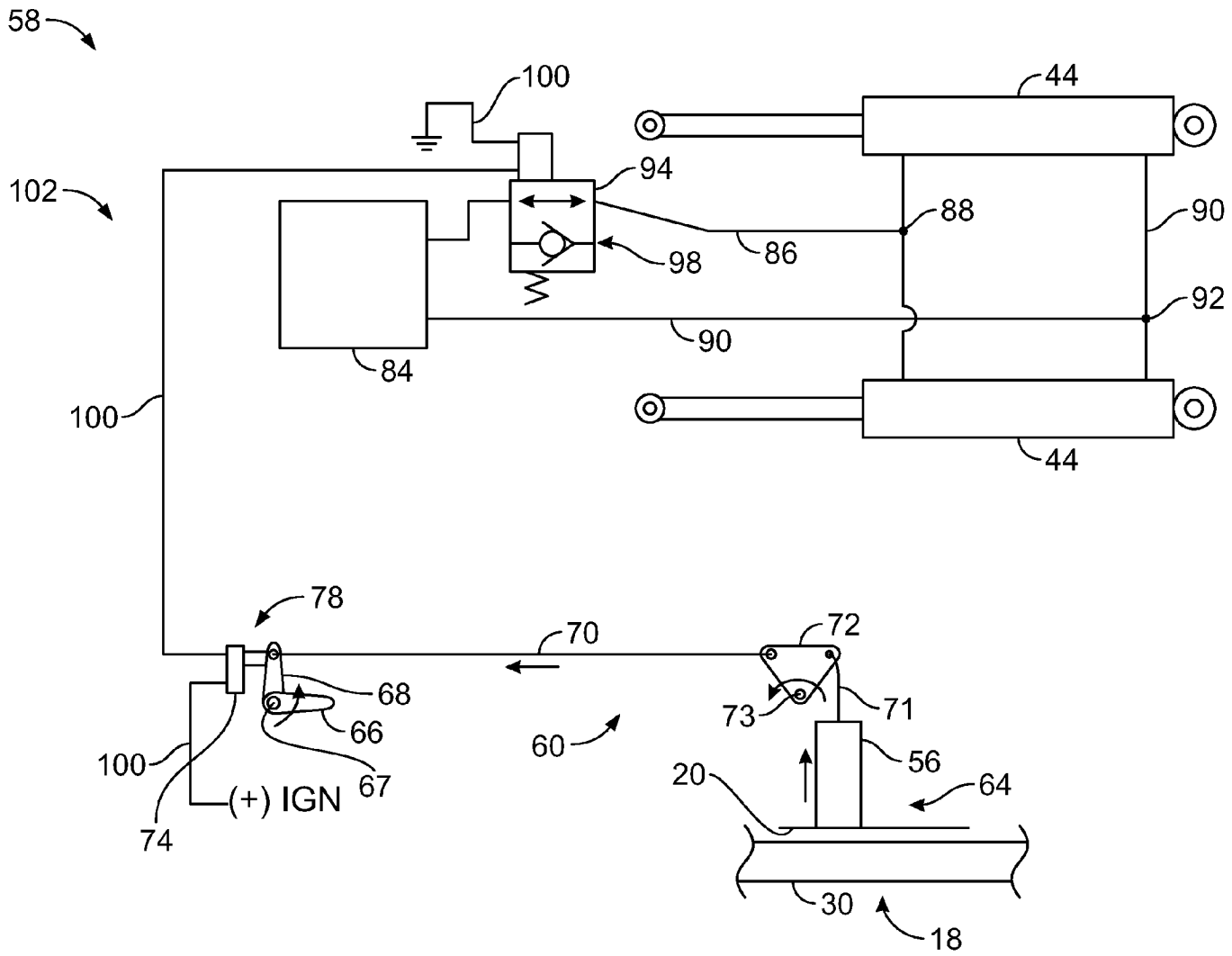
FIG. 3 is a schematic view of an exemplary work vehicle having a boom lock system with a stop member in a retracted position according to the present invention.

FIGS. 2-3 show schematically a stop member 56 used with a boom lock system 58 to selectably control pressurized fluid system 54 (FIG. 1) from applying a fluid force to lower boom structure 18 (FIG. 1). Boom lock system 58 selectably controls pressurized fluid system 54 by selectably controlling the flow of pressurized fluid to hydraulic cylinders 44 supporting boom structure 18. As further shown in FIGS. 2-3, stop member 56 is directed to move between a locking position 62 (FIG. 2) and a refracted position 64 (FIG. 3) by a linkage 60. As further shown in FIGS. 2-3, an exemplary embodiment of a linkage 60 includes a handle 66 such as located in cab 31 (FIG.1) operatively connected to a crank 68. Elongated elements 70, 71, such as push rods, collectively interconnect crank 68, pivot device 72 and stop member 56 to move in unison.

As shown in FIG. 2, in response to an operator applying a force in one direction to handle 66, handle 66 and crank 68 move in unison in a rotational direction about axis 67. In response to a corresponding movement of crank 68 away from a switch 74, switch 74 remains in an open position 76. Crank 68, which is interconnected with elongated element 70, pivot device 72, elongated element 71 and stop member 56, collectively urges elongated member 70 to then urge pivot device 72 in a rotational movement about an axis 73. Pivot device 72 then urges elongated element 71 and stop member 56 to move in unison outwardly from side member 20 toward and into the path of travel of a corresponding lower arm portion 30 of boom structure 18, which stop member 56 position being identified as a locking position 62. With stop member 56 moved to locking position 62, as can be seen in FIG. 1, stop member 56 would prevent a lowering movement of boom structure 18 from its extended position 34. That is, a lowering movement of boom structure 18, which would correspond to a movement of hydraulic cylinder 44 resulting in a reduced distance between opposed pivots 50, 52 of hydraulic cylinder 44, would similarly result in a rotational movement 80 of lower arm portion 30 about end 38 toward stop member 56 until lower arm portion 30 abuts stop member 56. Stated another way, stop member 56 when placed in locking position 62 with boom structure 18 positioned in an extended position 34, prevents a lowering movement of boom structure 18 beyond a predetermined height, such height resulting as a function of the placement of stop member 56 relative to boom structure 18, as well as the configuration of the boom structure.

As shown in FIG. 3, in response to an operator applying a force in one direction to handle 66 opposite that shown in FIG. 2, handle 66 and crank 68 move in unison in a rotational direction about axis 67. In response to a corresponding movement of crank 68 toward switch 74 until crank 68 is brought into abutting contact with switch 74, switch 74 achieves a closed position 78. Crank 68, which is interconnected with elongated element 70, pivot device 72, elongated element 71 and stop member 56, collectively urges elongated member 70 to then urge pivot device 72 in a rotational movement about an axis 73. Pivot device 72 then urges elongated element 71 and stop member 56 to move in unison outwardly from side member 20 toward the longitudinal centerline of the work vehicle away from and out of the path of travel of a corresponding lower arm portion 30 of boom structure 18, which stop member 56 position being identified as a retracted position 64. With stop member 56 moved to retracted position 64, as can be seen in FIG. 1, stop member 56 would permit unimpeded movement of boom structure 18, i.e., toward or away from its extended position 34. That is, in retracted position 64, stop member 56 cannot abut lower arm portion 30 of boom structure 18.

As further shown collectively in FIGS. 2-3, the position of switch 74, i.e., open position 76 or closed position 78, which is established by an operator as previously discussed, determines movement control of hydraulic cylinders 44, which in turn determines movement control of boom structure 18.

For example, as further shown in FIG. 2, an electrical circuit 102 comprises conductive wire 100 extending between switch 74 and ignition (the source of electrical current), as well as conductive wire 100 extending between switch 74 and a valve 94, such as a solenoid valve, and further including conductive wire 100 extending between valve 94 and an electrical ground of circuit 102. As further shown in FIG. 2, with switch 74 in open position 76, switch 74 is configured such that when switch 74 is in open position 76, electrical circuit 102 is an open circuit. Switch 74 is sometimes referred to as a normally open switch. In response to circuit 102 being open, no electrical current is provided to valve 94, which maintains valve 94 in a first position 96, which will be explained in further detail below.

As further shown in FIG. 2, valve 94 is interposed between loader valve 84 and the rod end of hydraulic cylinder 44. More specifically, valve 94 is interposed between portions of line 86 that extends between loader valve 84 which then bifurcates at bifurcation point 88 and terminates at the rod end of hydraulic cylinders 44. In response to a flow of pressurized hydraulic fluid from loader valve 84 to the rod end of hydraulic cylinders 44, the rod end and the base end of hydraulic cylinders 44 are urged toward each other, or hydraulic cylinders 44 are urged toward a retracted position, or a forced lowering of boom structure 18 (FIG. 1). However, valve 94 is not interposed between loader valve 84 and the base end of hydraulic cylinders 44. In response to a flow of pressurized hydraulic fluid from loader valve 84 to the base end of hydraulic cylinder 44, i.e., from loader valve 84 through line 90 with line 90 bifurcating at bifurcation point 92 and terminating at the base end of hydraulic cylinders 44, the rod end and the base end of hydraulic cylinders 44 are urged away from each other, or hydraulic cylinders 44 are urged toward an extended position, or a forced raising of boom structure 18 (FIG. 1).

As further shown in FIG. 2, in response to electrical circuit 102 being open and stop member 56 being in locking position 62, no electrical current is provided to valve 94, which maintains valve 94 in first position 96. In first position 96, valve 94 includes a one-way valve that prevents the flow of pressurized hydraulic fluid from loader valve 84 through line 86 to the rod end of hydraulic cylinders 44. In other words, with valve 94 in first position 96, hydraulic cylinders 44 cannot be forcefully retracted, i.e., hydraulic cylinders 44 cannot retract using pressurized hydraulic fluid. That is, operator controls cannot be utilized to forcefully retract hydraulic cylinders 44. However, valve 94 does not impede the flow of pressurized hydraulic fluid from rod end of hydraulic cylinders 44 to loader valve 84. That is, loader valve 84 can provide a flow of pressurized hydraulic fluid to the base end of hydraulic end of hydraulic cylinders 44, resulting in the rod end of hydraulic cylinders 44 providing a flow of hydraulic fluid back to loader valve 84, resulting in raising of boom structure 18 (FIG. 1). Stated another way, with valve 94 in first position 96, pressurized fluid system 54 (FIG. 1) of work vehicle 10 cannot forcefully lower boom structure 18, but can forcefully further raise boom structure 18.

In contrast to FIG. 2, and as further shown in FIG. 3, in response to electrical circuit 102 being closed, i.e., switch 74 being actuated to a closed position 78, valve 94 is actuated from first position 96 to second position 98. With valve 94 in second position 98, pressurized fluid from loader valve 84 is no longer prevented from flowing through line 86 to the rod ends of hydraulic cylinders 44. Positioning the valve 94 in second position 98 corresponds to the normal operating condition of work vehicle 10. That is, operator controls can be utilized to forcefully retract or extend hydraulic cylinders 44.

As a result of boom lock system 58, in which an operator actuates linkage 60 such that stop member 56 achieves a locking position 62 and switch 74 achieves an open position 76, creating an open electrical circuit 102, valve 94 remains in first position 96, preventing pressurized fluid system 54 from applying a fluid force to lower boom structure 18. By preventing pressurized fluid system 54 from applying a fluid force to lower boom structure 18 when stop member 56 is placed in locking position 62, the size of structural components associated with the fluid system and boom structure 18 can be reduced. That is, by virtue of boom lock system 58, structural components associated with the fluid system and boom structure 18 no longer must be constructed to withstand an inadvertent command to forcefully lower boom structure 18. In addition, a single stop member 56 can then safely and reliably be utilized, versus requiring a pair of stop members 56, i.e., one stop member corresponding to each arm of boom structure 18.

Figure 4:
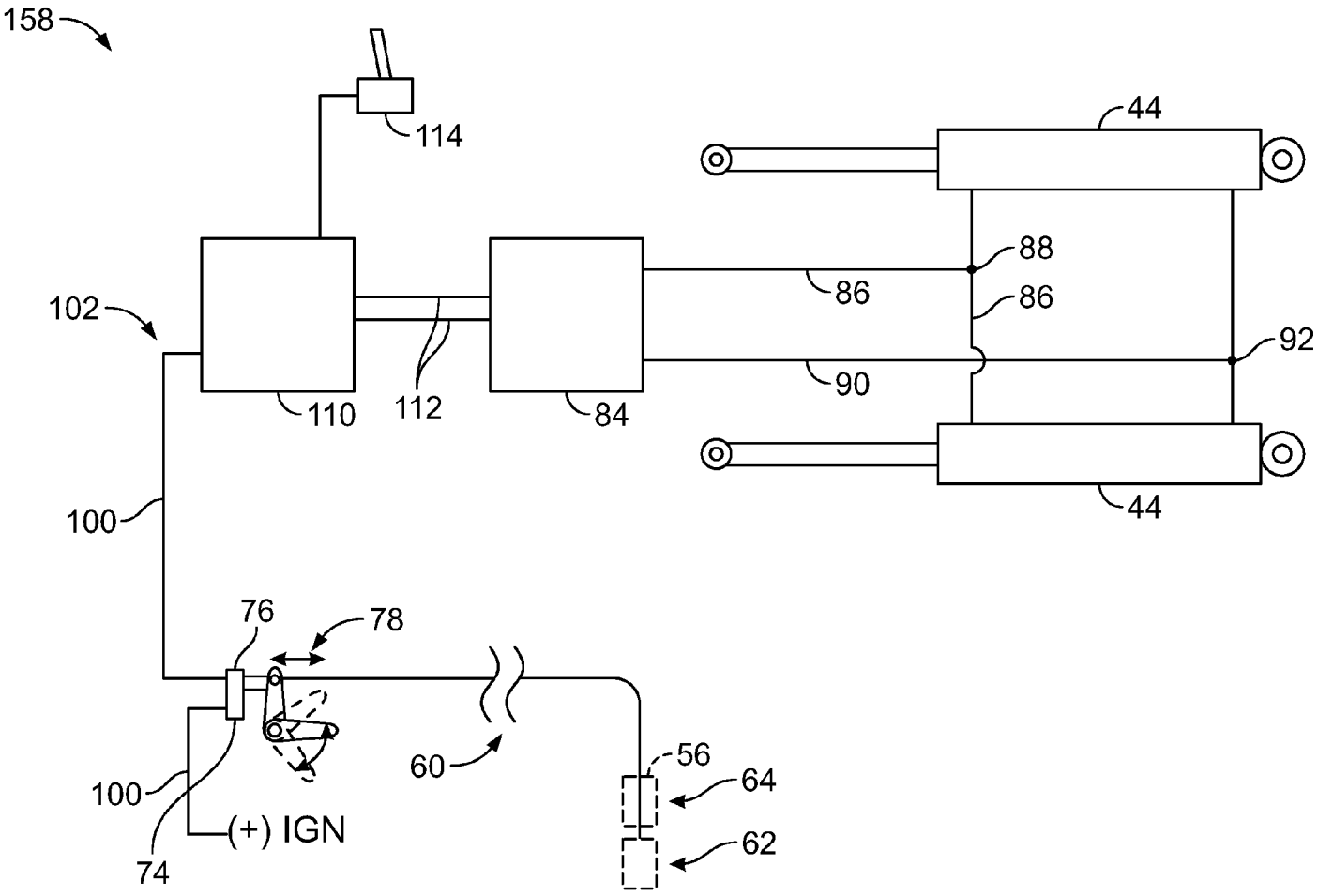
FIG. 4 is a schematic view of an exemplary embodiment of a boom lock system according to the present invention.

FIG. 4 shows an alternate embodiment of a boom lock system 158. Boom lock system 158 includes a controller 110, such as is used with an electro-hydraulic control system for a work vehicle. As further shown in FIG. 4, a wiring harness 112 electrically connects controller 110 and loader valve 84. In another embodiment, controller 110 and loader valve 84 may have a wireless connection. In response to stop member 56 being positioned in locking position 62 and linkage 60 positioning switch 74 in open position 76 such that electrical circuit 102 is open, a +0 volt signal is provided to controller 110. In response to controller 110 receiving the +0 volt signal, controller 110 disregards a signal from operator controlled device 114, such as a joystick, corresponding to forcefully lowering the boom structure, i.e., retracting hydraulic cylinders 44. Conversely, in response to stop member 56 being positioned in retracted position 64 and linkage 60 positioning switch 74 in closed position 78 such that electrical circuit 102 is closed, a +12 volt signal is provided to controller 110. In response to controller 110 receiving the +12 volt signal, controller 110 acknowledges control signals from operator controlled device 114 corresponding to forcefully lowering the boom structure, i.e., retracting hydraulic cylinders 44. It is to be understood that other voltage values and arrangements may be utilized.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A work vehicle comprising:

a frame including generally upwardly extending laterally spaced side members;

a boom structure including a pair of arms pivotably connecting the boom structure to the frame;

a pressurized fluid system operably associated with the boom structure for raising and lowering jointly each of the arms along a path of travel adjacent a corresponding side member;

a stop member selectably extending outwardly from at least one of the side members between a locking position and a retracted position, the locking position extending at least a portion of the stop member into the path of travel of a corresponding arm of the boom structure to prevent a lowering movement of the boom structure beyond a predetermined height; and a boom lock system for preventing the fluid system from applying a fluid force to lower the boom structure when the stop member is in the locking position;

wherein the boom lock system comprises a selectably actuatable switch between a first position and a second position, the first position corresponding to the stop member being in the locking position;

wherein the boom lock system comprises an electrical circuit comprising the switch and a valve in fluid communication with the boom structure, wherein in response to the switch being in the first position, the electrical circuit is open, preventing the fluid system from applying a fluid force to lower the boom structure.

2. The work vehicle of claim 1, wherein the boom lock system permits the fluid system to apply a fluid force to raise the boom structure.

3. The work vehicle of claim 2, wherein the boom lock system comprises an electrical circuit comprising the switch and a controller operably connected to the fluid system, wherein in response to the switch being in the first position, the electrical circuit is open, preventing operation of operator controls associated with lowering the boom structure.

4. The work vehicle of claim 2, wherein the boom lock system comprises an electrical circuit comprising the switch and a controller operably connected to the fluid system, wherein in response to the switch being in the second position, the electrical circuit is closed, permitting operation of operator controls associated with lowering the boom structure.

5. The work vehicle of claim 1, wherein the stop member is actuable to the locking position when a corresponding arm of the boom structure is positioned at or above the predetermined height.

6. The work vehicle of claim 1, wherein the boom lock system comprises an electrical circuit comprising the switch and a valve in fluid communication with the boom structure, wherein in response to the switch being in the second position, the electrical circuit is closed, permitting the fluid system to apply a fluid force to raise and lower the boom structure.

7. The work vehicle of claim 6, wherein the valve is a solenoid control valve.

8. The work vehicle of claim 1, wherein the valve is a solenoid control valve.

9. The work vehicle of claim 1, wherein the boom lock system comprises an operator actuated linkage connected to the switch and the stop member.

10. The work vehicle of claim 9, wherein the linkage is actuatable from inside a cab of the work vehicle.

11. The work vehicle of claim 1, wherein the stop member is actuatable to the locking position when a corresponding arm of the boom structure is positioned at or above the predetermined height.

12. A work vehicle comprising:

a frame including generally upwardly extending laterally spaced side members;

a boom structure including a pair of arms pivotably connecting the boom structure to the frame;

a pressurized fluid system operably associated with the boom structure for raising and lowering jointly each of the arms along a path of travel adjacent a corresponding side member;

a stop member selectably extending outwardly from at least one of the side members between a locking position and a retracted position, the locking position extending at least a portion of the stop member into the path of travel of a corresponding arm of the boom structure to prevent a lowering movement of the boom structure beyond a predetermined height; and a boom lock system for preventing the fluid system from applying a fluid force to lower the boom structure, while permitting the fluid system to apply a fluid force to raise the boom structure, when the stop member is in the locking position;

wherein the boom lock system comprises a selectably actuatable switch between a first position and a second position, the first position corresponding to the stop member being in the locking position;

wherein the boom lock system comprises an electrical circuit comprising the switch and a valve in fluid communication with the boom structure, wherein in response to the switch being in the first position, the circuit is open, preventing the fluid system from applying a fluid force to lower the boom structure.

13. The work vehicle of claim 12, wherein the boom lock system comprises an electrical circuit comprising the switch and a controller operatively connected to the fluid system, wherein in response to the switch being in the first position, the circuit is open, preventing operation of operator controls associated with lowering the boom structure.

14. The work vehicle of claim 12, wherein the boom lock system comprises an electrical circuit comprising the switch and a controller operatively connected to the fluid system, wherein in response to the switch being in the second position, the circuit is closed, permitting operation of operator controls associated with lowering the boom structure.

15. The work vehicle of claim 12, wherein the stop member is actuatable to the locking position when a corresponding arm of the boom structure is positioned at or above the predetermined height.

16. A method for operating a work vehicle comprising:

providing a frame including generally upwardly extending laterally spaced side members; a boom structure including a pair of arms pivotably connecting the boom structure to the frame; a pressurized fluid system operably associated with the boom structure for raising and lowering jointly each of the arms along a path of travel adjacent a corresponding side member; a stop member selectably extending outwardly from at least one of the side members between a locking position and a retracted position, the locking position extending at least a portion of the stop member into the path of travel of a corresponding arm of the boom structure to prevent a lowering movement of the boom structure beyond the predetermined height; and preventing the fluid system from applying a fluid force to lower the boom structure when the stop member is in the locking position with a boom lock system;

wherein the boom lock system comprises a selectably actuatable switch between a first position and a second position, the first position corresponding to the stop member being in the locking position;

wherein the boom lock system comprises an electrical circuit comprising the switch and a valve in fluid communication with the boom structure, wherein in response to the switch being in the first position, the electrical circuit is open, preventing the fluid system from applying a fluid force to lower the boom structure.

* * * * *